US007007799B2

(12) United States Patent
Coté

(10) Patent No.: US 7,007,799 B2
(45) Date of Patent: Mar. 7, 2006

(54) BOX FOR PAYOUT OF A FILAMENTARY PRODUCT

(75) Inventor: Gerard Coté, LaPrairie (CA)

(73) Assignee: Nordx/CDT, Inc., Pointe-Claire (CA)

( * ) Notice: Subject to any disclaimer, the term of this patent is extended or adjusted under 35 U.S.C. 154(b) by 0 days.

(21) Appl. No.: 10/635,136

(22) Filed: Aug. 5, 2003

(65) Prior Publication Data

US 2004/0026284 A1 Feb. 12, 2004

Related U.S. Application Data

(60) Provisional application No. 60/401,223, filed on Aug. 5, 2002.

(51) Int. Cl.
*B65D 85/04* (2006.01)

(52) U.S. Cl. ..... 206/409; 206/389; 206/395; 229/112; 242/171; 242/588.4

(58) Field of Classification Search ..... 206/389, 206/395, 409, 702; 229/112; 242/157 R, 242/163, 171, 172, 588.3, 588.4
See application file for complete search history.

(56) References Cited

U.S. PATENT DOCUMENTS 512,581 A * 1/1894 Greene ..... 229/112
3,178,092 A * 4/1965 Munana et al. ..... 229/112
3,587,840 A 6/1971 Hultberg
3,693,784 A 9/1972 Holmes
4,019,636 A * 4/1977 Wise ..... 206/396
4,069,917 A * 1/1978 Stollberg et al. ..... 206/423
4,151,914 A 5/1979 Blatt
4,160,533 A 7/1979 Kotzur
4,274,607 A 6/1981 Priest
4,373,687 A * 2/1983 Zicko ..... 242/163
4,382,510 A 5/1983 Gaffney
4,417,660 A 11/1983 Mason
4,817,796 A * 4/1989 Camillo et al. ..... 206/396
5,064,136 A 11/1991 Hunt
5,115,995 A 5/1992 Hunt
5,152,476 A 10/1992 Moser
5,368,245 A 11/1994 Fore
5,494,160 A * 2/1996 Gelmetti ..... 206/395
5,520,347 A 5/1996 Bass et al.
5,529,186 A * 6/1996 Bass ..... 206/395
5,704,479 A 1/1998 Barnett et al.
5,715,992 A * 2/1998 Andrews et al. ..... 229/125.15
5,810,272 A 9/1998 Wallace et al.
5,909,841 A * 6/1999 Andrews et al. ..... 229/125.15
5,979,811 A * 11/1999 Bass et al. ..... 242/157 R
5,979,812 A 11/1999 Kotzur et al.
6,086,012 A 7/2000 Kotzur et al.
6,109,554 A 8/2000 Kotzur et al.

(Continued)

*Primary Examiner*—John A. Ricci
(74) *Attorney, Agent, or Firm*—Lowrie, Lando & Anastasi LLP

(57) ABSTRACT

A box for payout of a filamentary product such as cable or wire that is wound in a coil inside of the box. The box is constructed to retain the coil securely and utilize material in an efficient manner. Particularly, the box is adapted to retain a figure-eight coil of wire, which is often formed in an irregular shape. The box may include a payout tube that extends from a point outside of the box through a wall of the coil and into an interior point of the coil. The box serves to retain such a payout tube with an efficient amount of material and also provides for an improved method of assembling the box, the coil, and the payout tube.

20 Claims, 9 Drawing Sheets

U.S. PATENT DOCUMENTS 6,328,238 B1 12/2001 Chism 6,341,691 B1 1/2002 Voss

* cited by examiner

BOX FOR PAYOUT OF A FILAMENTARY PRODUCT

BACKGROUND

The present invention relates to a box and payout tube construction designed to contain a coil of filamentary material for smoothly dispensing such filamentary material, and particularly to a box designed to contain a figure eight coil of filamentary material.

The figure eight coil arrangement has been in use in the wire and cable industry for many years to help payout at installation and to help prevent a cable from twisting when it is dispensed from the coil during an installation process. The figure eight coil generally includes loops of coil arranged between two divergent planes, crossing back and forth to define an opening through one side wall or edge of the coil. This creates a coil with one side that is wider than an opposing side. These coils of wire having sides of differing widths create problems for handling and packaging of the coil. Conventional coil packaging heretofore in use is comparatively expensive to make and often holds such coils inefficiently. Moreover, conventional packaging has problems paying out the wire, cable or other filamentary materials without kinks or knots. Conventional packaging, in attempts to overcome payout problems is complex, relatively weak, and occupies excessive space.

SUMMARY OF THE INVENTION

According to some embodiments of aspects of the inventions a box for paying out filamentary material from a coil of filamentary material contained in the box includes a pair of opposite faces and a front face with an aperture formed in the front face. The aperture is shaped and sized to permit payout of the filamentary material through the aperture, and the opposite faces are on divergent planes. The opposite faces each share an edge with the front face. The box may further include a second pair of opposite faces, wherein said second pair of opposite faces are trapezoid shapes. The box may not further include a payout tube extending from the aperture and through an opening formed through an edge of the coil for permitting payout of filamentary material. The payout tube may include a filament lock defined in a wall of the payout tube for retaining an outer end of the filamentary material. The filament lock may include an opening through the wall of the payout tube and retention fingers extending into the opening to hold the outer end of the cable. A flange may extend outwardly from an outer end of the payout tube and the payout tube flange may be secured to the front face. The payout tube may be tapered. The flange may be secured to the outside of the box. The payout tube may be a multifaceted wall of alternating flat and arcuate sections. The multifaceted wall may have four flat sections and four arcuate sections. A recess may be defined in the payout tube to engage an edge of the aperture. The recess may be a slot defined through a wall of the payout tube. Alternatively, the recess may be a groove defined around the payout tube near an outer end. The front face of the box may be formed of two overlapped flaps, one of which has a slot defined therein for receiving the payout tube radially to a central axis of the payout tube. The slot for receiving the payout tube may have tabs defined thereabout for retaining the payout tube. Alternatively, the slot may have a keyhole shape for retaining the payout tube. The box may be defined by two sheets of material. In that case, the second sheet of material may define the one of the flaps having the slot. Alternatively, the box may be defined by only one sheet of material. The opposite faces on divergent planes may be inner faces, and the box may further have a pair of outer faces on parallel planes outside of the pair of opposite faces on divergent planes.

The various embodiments of aspects of the invention may, except where clearly mutually exclusive, be freely combined by the skilled artisan. The box, loaded with a coil of filamentary material, for example wire, cable, optical fiber or the like, also embodies aspects of the invention.

BRIEF DESCRIPTION OF THE DRAWINGS

The invention is described with reference to the following drawings, in which similar reference numbers indicated similar structures.

DETAILED DESCRIPTION

The present invention will be better understood upon reading the following detailed description of various embodiments of aspects thereof in connection with the drawings.

Embodiments of aspects of the present invention may be found in a box including features for holding and stabilizing a figure eight coil using a minimum of materials and a minimum of assembly labor. Embodiments of aspects of the invention can be shaped for minimum, close-packed volume when finished cartons of filamentary material are palletized, thus increasing pallet capacity significantly over conventional packaging. For example, using an embodiment of aspects of the present invention to package 305 m. (1,000 ft.) coils of Category 5E cable, Nordx/CDT, Inc. can achieve a total capacity per pallet of 13,725 km. (45,000 ft.), compared with conventional packaging, which achieves a total capacity per pallet of only 10,980 km. (36,000 ft.), thus saving substantially on shipping costs.

Embodiments of some aspects of the invention are constructed using one sheet of single-wall corrugated cardboard, plastic, or other suitable material configured for high strength, in combination with a payout tube constructed of a single piece of plastic or other suitable material. The configuration is a single sheet of material cut and folded to have six sides, with two opposing faces lying on different planes. The sheet may be formed by any suitable method, such as die cutting. As will be explained below, in greater detail, one or more of the faces may be constructed of plural, overlapped flaps. In addition to providing structural integrity, the combination of shapes used results in a container that holds a figure eight coil of filamentary material with high stability, little movement and little deformation during shipping or transportation. The container has an inside shape that closely follows the contours of a figure eight coil packaged therein.

Other embodiments having similar characteristics to those described above can be constructed of two or more sheets of material. The faces lying on the divergent planes can be inner faces, surrounded by faces not lying on divergent planes.

When constructed as described using either a single sheet of material or plural sheets of material, where components of the box are joined using sliding tabs and slots as necessary, the use of glue and excess labor are advantageously avoided.

A figure eight coil has a generally circular profile (see for example, FIG. 5,501), formed of loops of filamentary material that cross over from one side of the coil to the other, periodically switching in which direction they cross. In the coil's simplest form, the loops cross alternately in one direction and then the other, without crossing an opening formed at one edge of the coil. The edge at which the opening is formed is wider than the opposite edge, the entire coil being bounded by two divergent planes.

Figure 1:
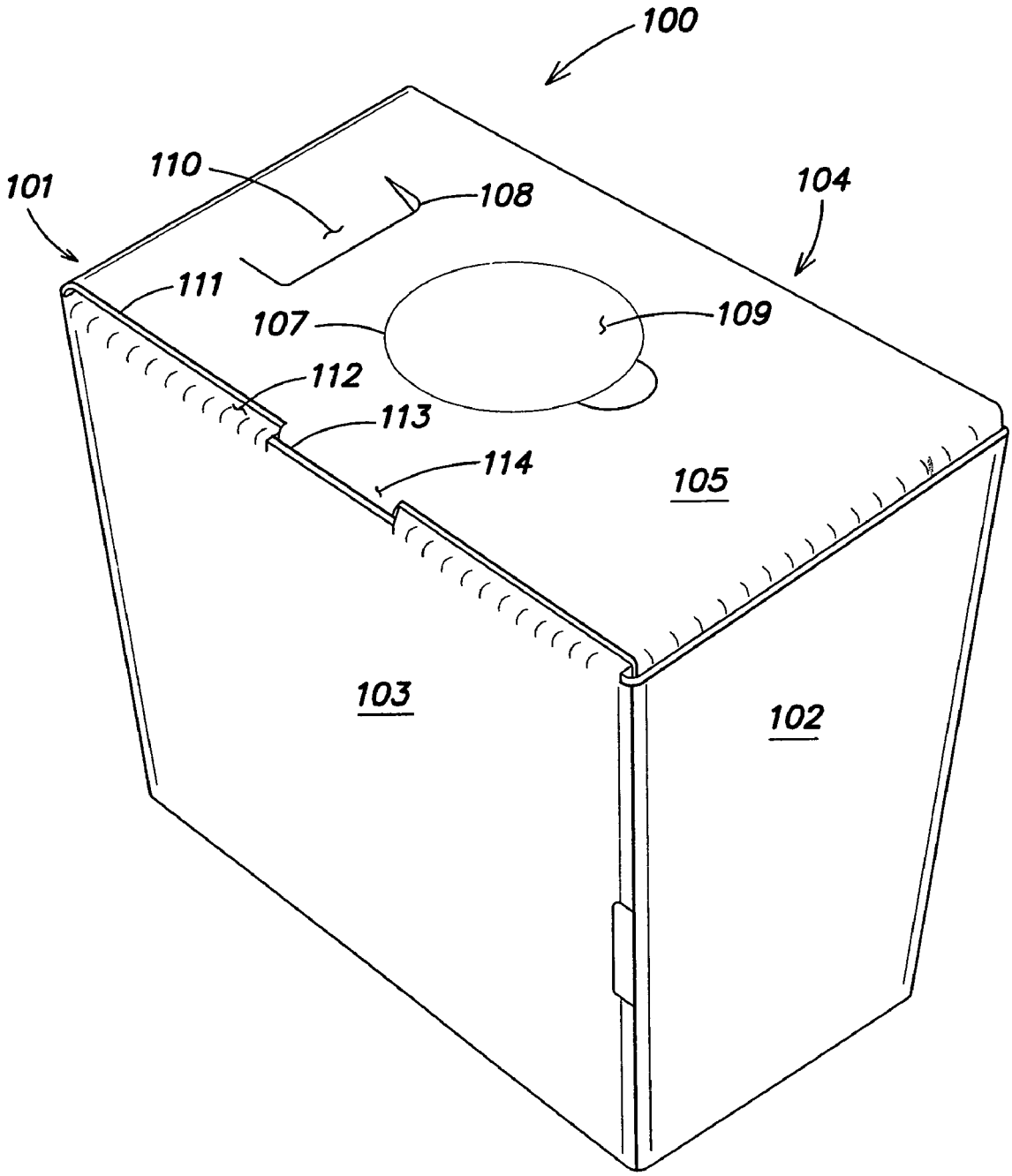
FIG. 1 is a perspective view of an embodiment of aspects of the invention.

A first embodiment of aspects of the invention, as shown in FIG. 1, comprises a box 100, preferably formed of corrugated cardboard or another suitable, stiff, light material. The material of which box 100 is formed should be selected to adequately support the contents for shipping. Corrugated cardboard is generally preferred for shipping wire and cable products because it is cheap, light and strong, although alternatively, other suitable materials may also be used.

Box 100 has six faces, 101, 102, 103, 104, 105 and 106. For convenience, they will be referred to as top, bottom, left, right, front, and back, respectively, although in practice the box 100 may be oriented in any convenient direction, for example with top 101 downwardly facing and bottom 102 upwardly facing. Front face 105 has two apertures 107 and optionally 108 defined therethrough. A punch-out cover 109 or flap 110 may, optionally, temporarily cover the apertures 107 and 108, respectively, until they are ready for use. Aperture 107 is for payout of the filamentary material carried in box 100, while aperture 108 defines a handle for easy carrying of the packaged filamentary material. Cover 109 and flap 110 present entry into box 100 of foreign matter of debris, before a point in time when filamentary material is to be dispensed.

Faces 103 and 104 of box 100 define two divergent planes which preferably roughly coincide with the divergent planes bounding the coil to be carried therein. The generally circular profile of the coil can be bounded by four orthogonally located planes, e.g., the planes defined by faces 101, 102, 105, and 106. When placed in box 100 the opening formed in the edge of the coil, which is used for payout of the filamentary material, coincides with face 105 including aperture 107. Prior to placement in the box 100, a payout tube (FIG. 2, 205) is inserted through the opening in the edge of the coil to hold it open for passage of the filamentary material as it is payed out.

Front side 105 is defined by two overlapping flaps, an outer flap 111 and an inner flap 112. Inner flap 112 will now be described in further detail in connection with FIG. 2. A slot 113 at an edge of front face 105 and defined through inner flap 112 receives a tab 114 defined at an edge of outer flap 111, so that when the box 100 is assembled, the outer flap 111 and inner flap 112 are securely joined.

Figure 2:
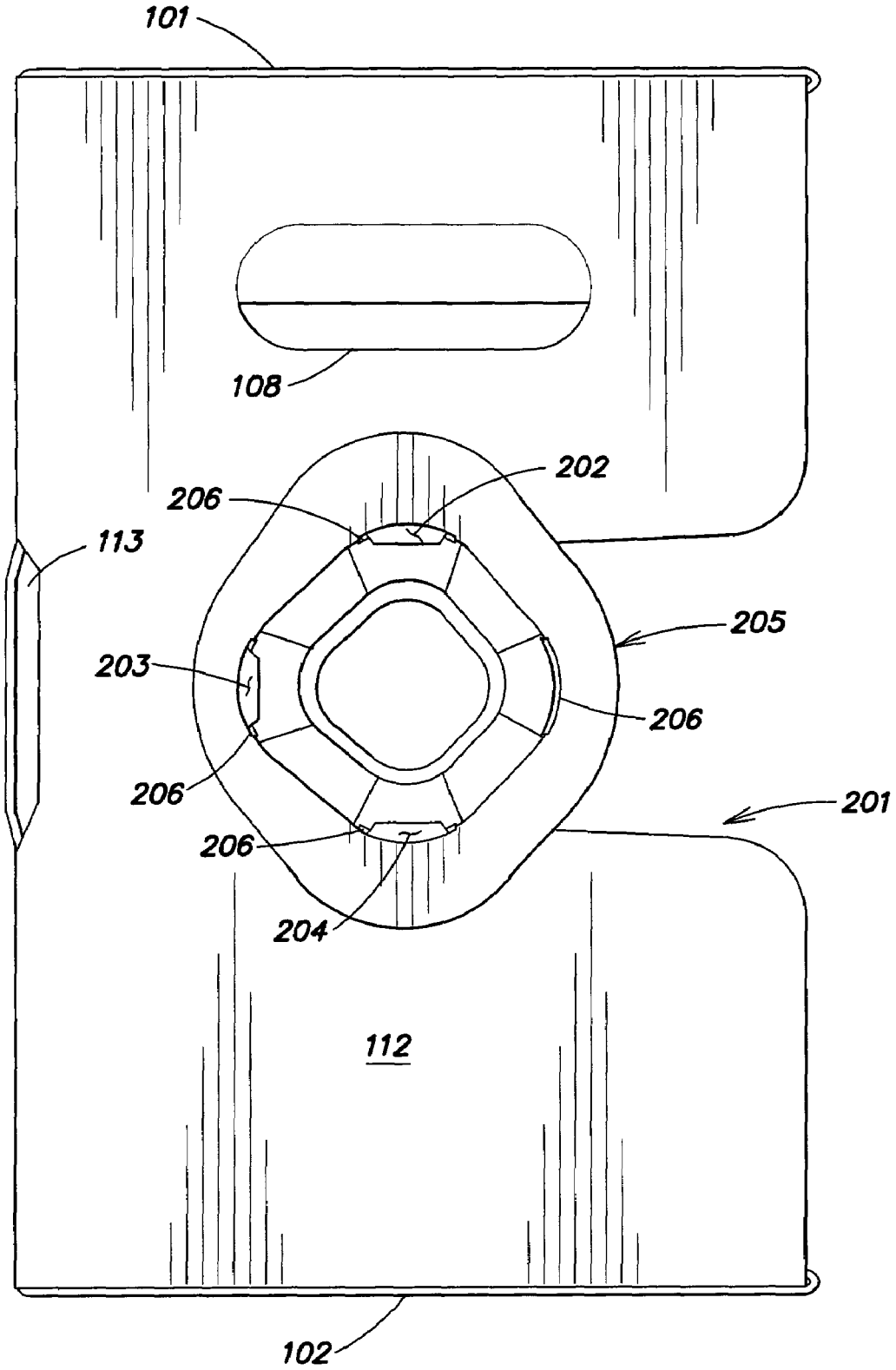
FIG. 2 is a detail of the embodiment of FIG. 1 showing how the payout tube is retained.

As shown in FIG. 2, inner flap 112 has a large opening or slot 201 with tabs 202, 203, and 204 which secure a payout tube 205 in place. Payout tube 205 is slid through opening or slot 201 until tabs 202, 203 and 204 grip payout tube 205 through slots 206. Also seen in this view are slot 113 and aperture 108. Note that aperture 108 is defined through both the outer flap 111 and the inner flap 112.

Details of the construction of top 101 and bottom 102, as well as other hidden flaps, is now discussed in connection with FIG. 3.

Figure 3:
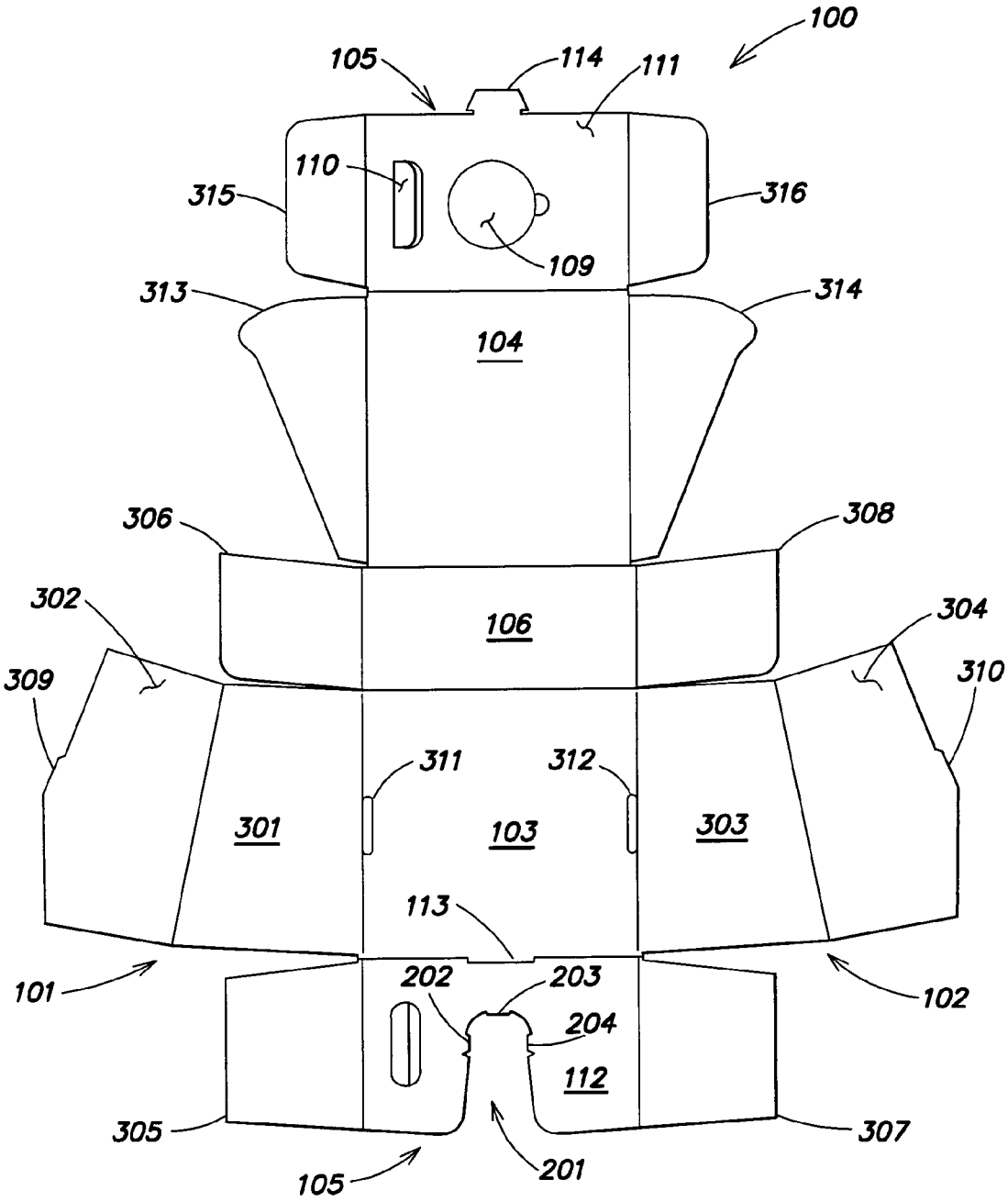
FIG. 3 is a layout view of the embodiment of FIG. 1 prior to folding up into the shape shown in FIG. 1.

FIG. 3 shows box 100 unfolded and laid flat as it would be prior to assembly. The surfaces seen in this view are generally interior surfaces. Outer flap 111 and inner flap 112 comprising front face 105 appear at the top and bottom, respectively, of the figure. Between outer flap 111 and inner flap 112 are disposed, in order, right face 104, back 106, and left face 103. In the orientation shown in the figure, attached to left face 103 on its left are outer top flap 301 and inner top flap 302, comprising top face 101. Disposed to the right of left face 103 are outer bottom flap 303 and inner bottom flap 304, comprising bottom face 102. In order to retain the back face 106 and the inner front flap 112 in position when the box is assembled, flaps 301 and 302 wrap around large tabs 305 and 306, while flaps 303 and 304 wrap around large tabs 307 and 308. Assembled faces 101 and 102 are held in place by tabs 309 and 310, which are retained in slots 311 and 312, respectively.

After faces 101, 102, 106 and inner flap 112 are assembled as described above, a coil of filamentary material with a payout tube 205 inserted can be slid into place. As described above in connection with FIG. 2, the payout tube 205 is slid into opening 201 and retained by tabs 202, 203 and 204. Large tabs 313 and 314 are folded up and slid into box 100 between the coil of filamentary material and faces 101 and 102, respectively, while large tabs 315 and 316 are slid between outer top flap 301 and large tab 305 and outer bottom flap 303 and large tab 307, respectively. Finally, tab 114 is inserted into slot 113, thus closing the box. Other means can be used to secure the box, either in addition to or instead of the tab 114 and slot 113 described. For example, glue, tape, or the like, can be used to secure the box closed. The box may be assembled as described by a progressive die folding machine, manually, or by any other suitable method.

Figure 4:
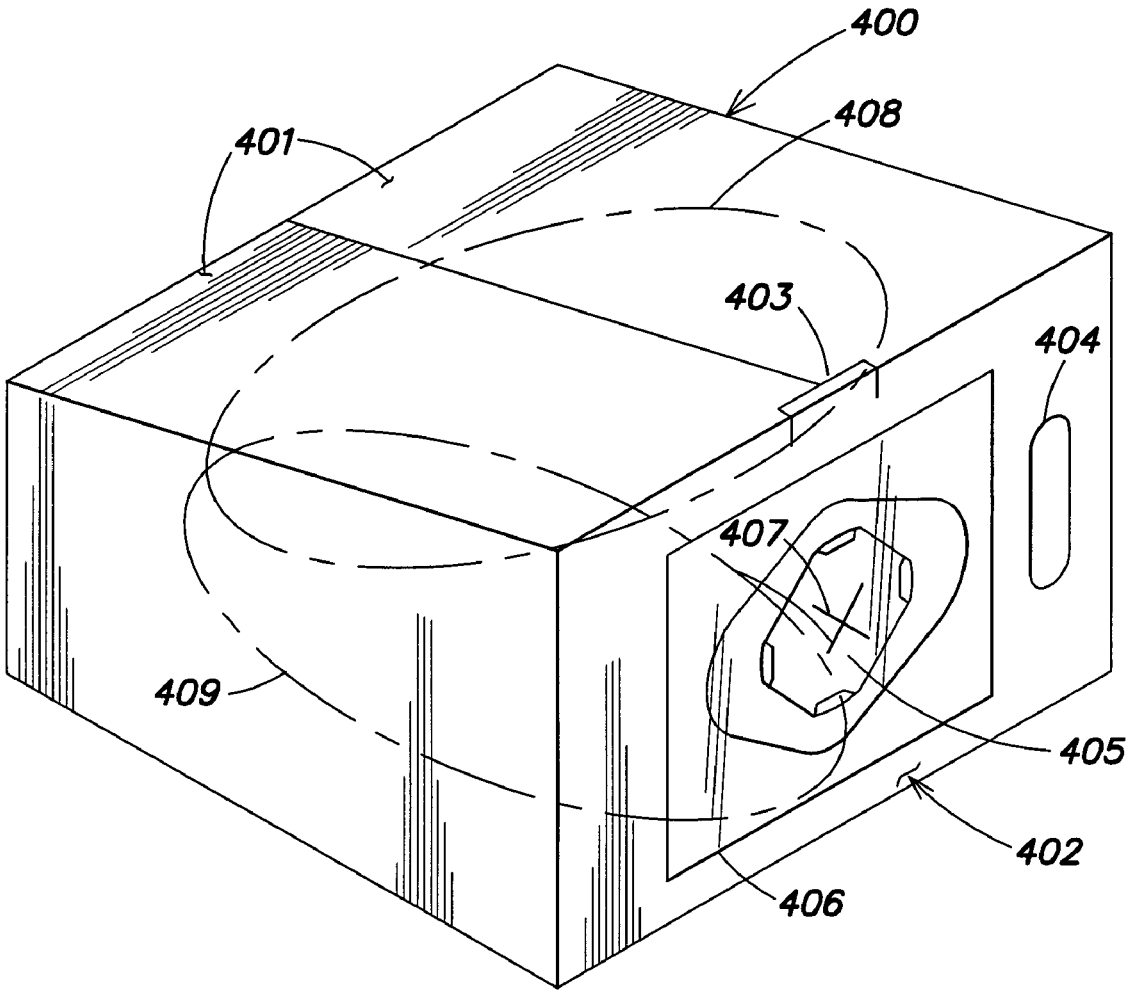
FIG. 4 is a perspective view of an embodiment of the aspects of the invention.

An alternative embodiment of aspects of the invention is shown in FIG. 4. An openable face 401 is adjacent to the end 402 of the box 400, although it could be on another side in other embodiments. The openable face 401 is used to insert the coil into the box 400, and can also be used to access the inside of the box for any other reasons that might present themselves. The openable face 401 can comprise a single flap that substantially covers the side or, it may comprise multiple flaps as shown in FIG. 4. Embodiments of the invention may also have a second openable face 401 opposed to the openable face shown in FIGS. 4 and 5. The openable faces 401 of the box are also shown to be held in a closed position with the assistance of locking tabs 403. These locking tabs 403 comprise portions of cardboard that fit between adjacent sides of the box to help retain the openable faces 401 in the closed position. Other embodiments may employ different types of locking means such as tape, glue, or other suitable means as the invention is not limited in this respect. Another feature depicted in FIG. 4 is a handle 404, shown as an opening which is disposed on the end 402 of the box. The handle 404 could also be located on any of the other walls of the box 400 and could comprise other suitable features, such as a strap that is fastened to the box as the invention is not limited in this respect.

Figure 5:
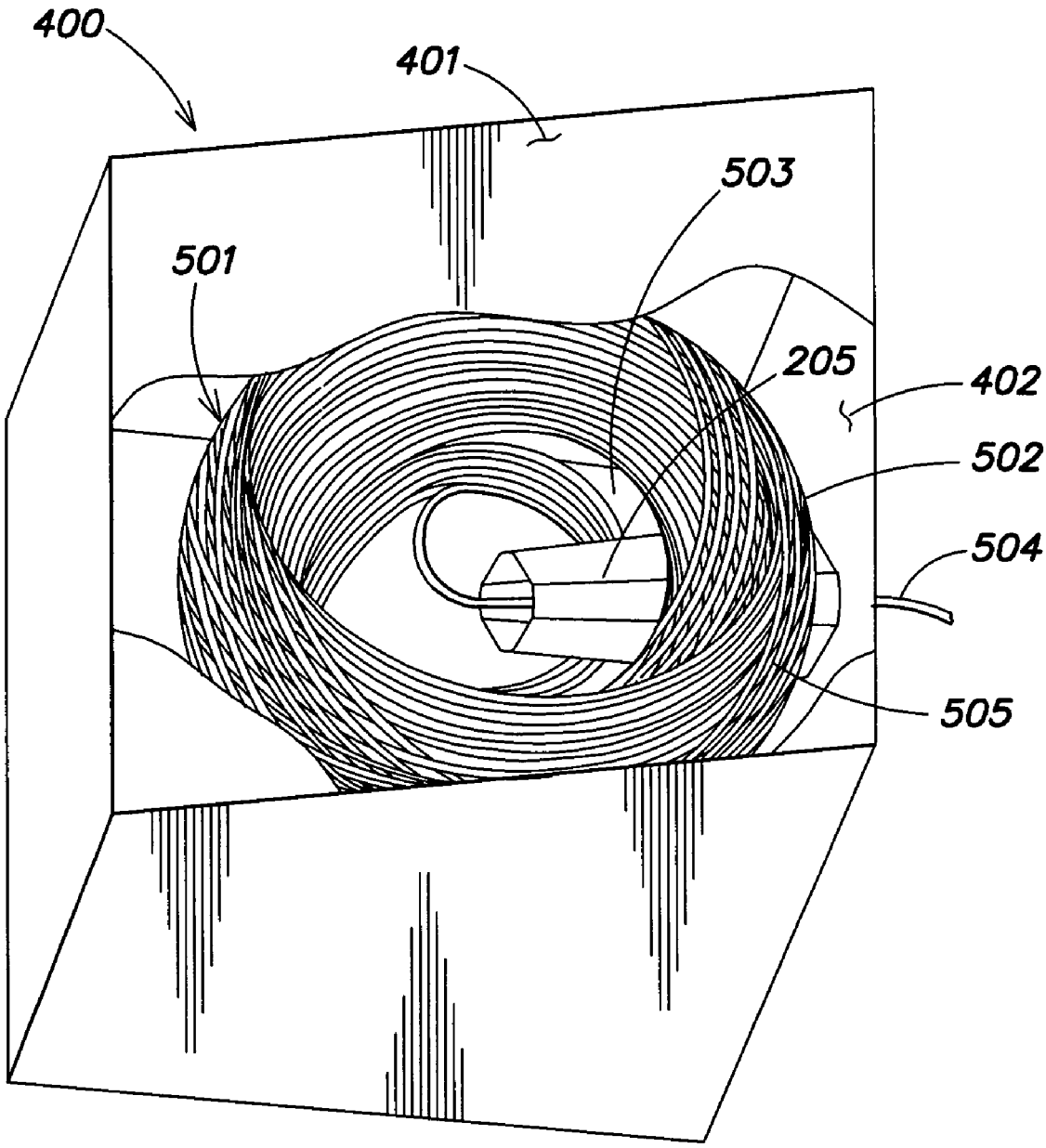
FIG. 5 is a fragmentary perspective view of the embodiment of FIG. 4, viewed from above and showing cable being dispensed from a coil through a payout tube.
Figure 6:
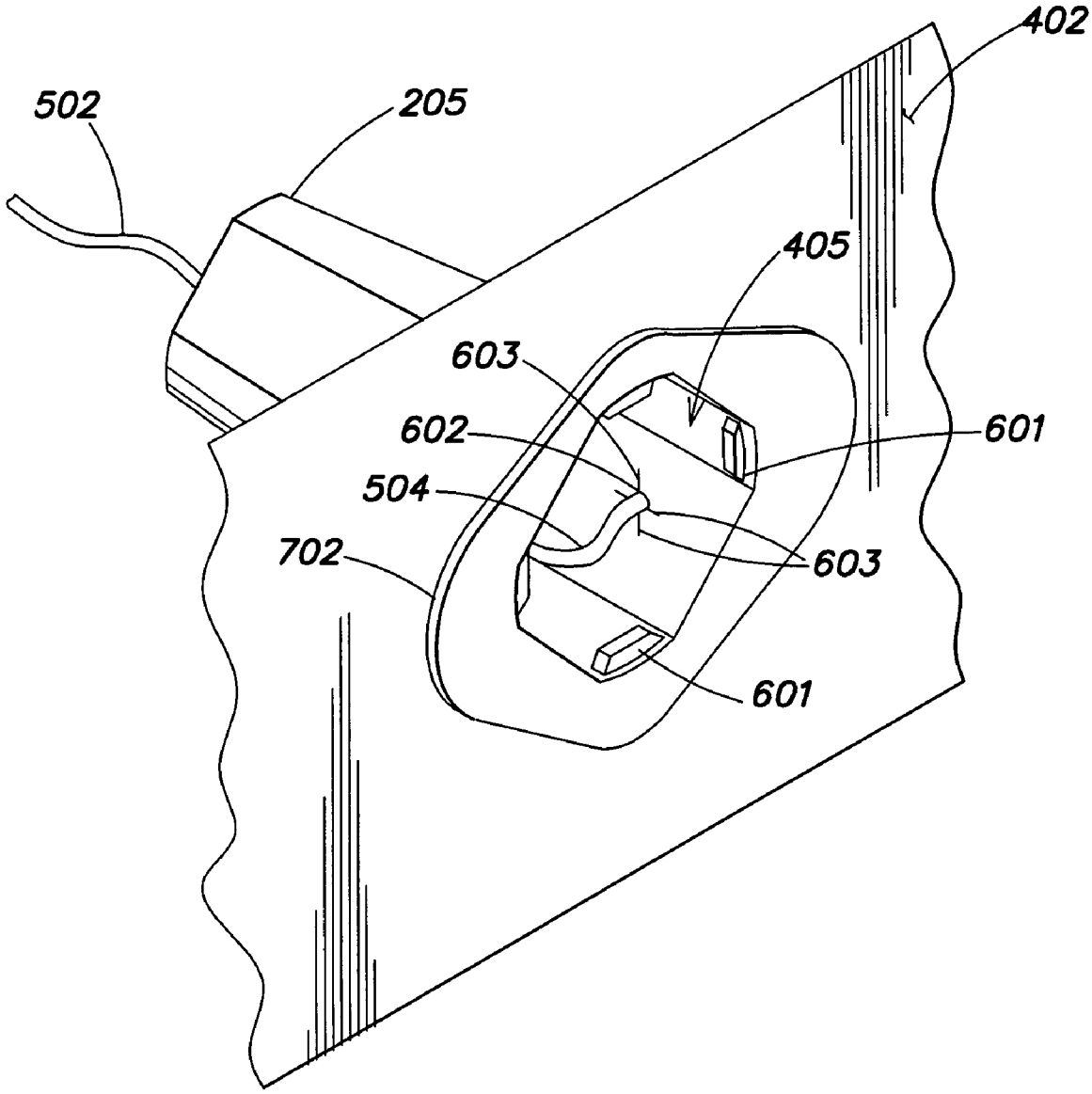
FIG. 6 is a fragmentary perspective view of the box end showing the payout tube extending through the box end, and an end of the cable locked in a cable lock.
Figure 7:
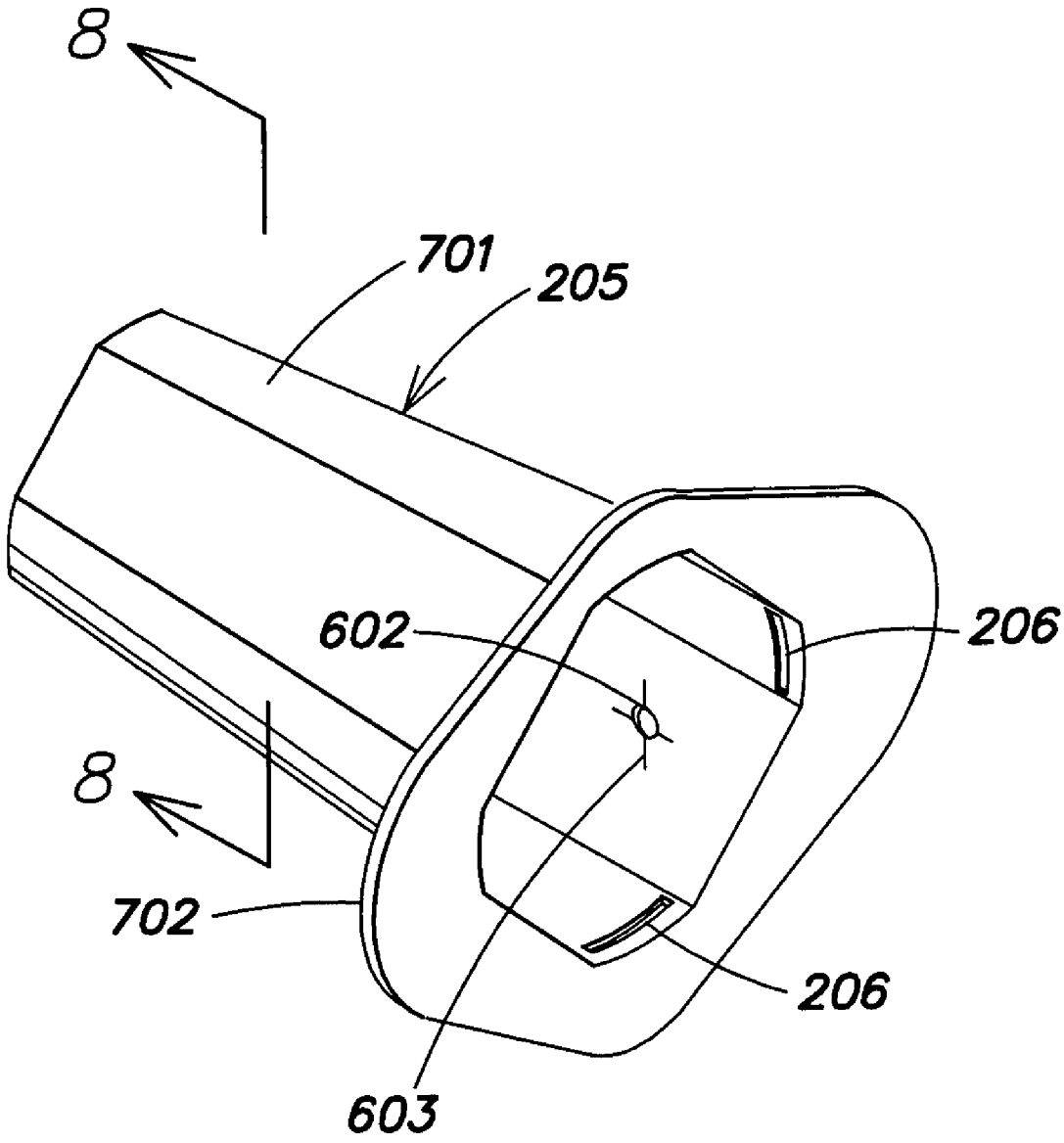
FIG. 7 is a perspective view of a payout tube with a cable lock.
Figure 8:
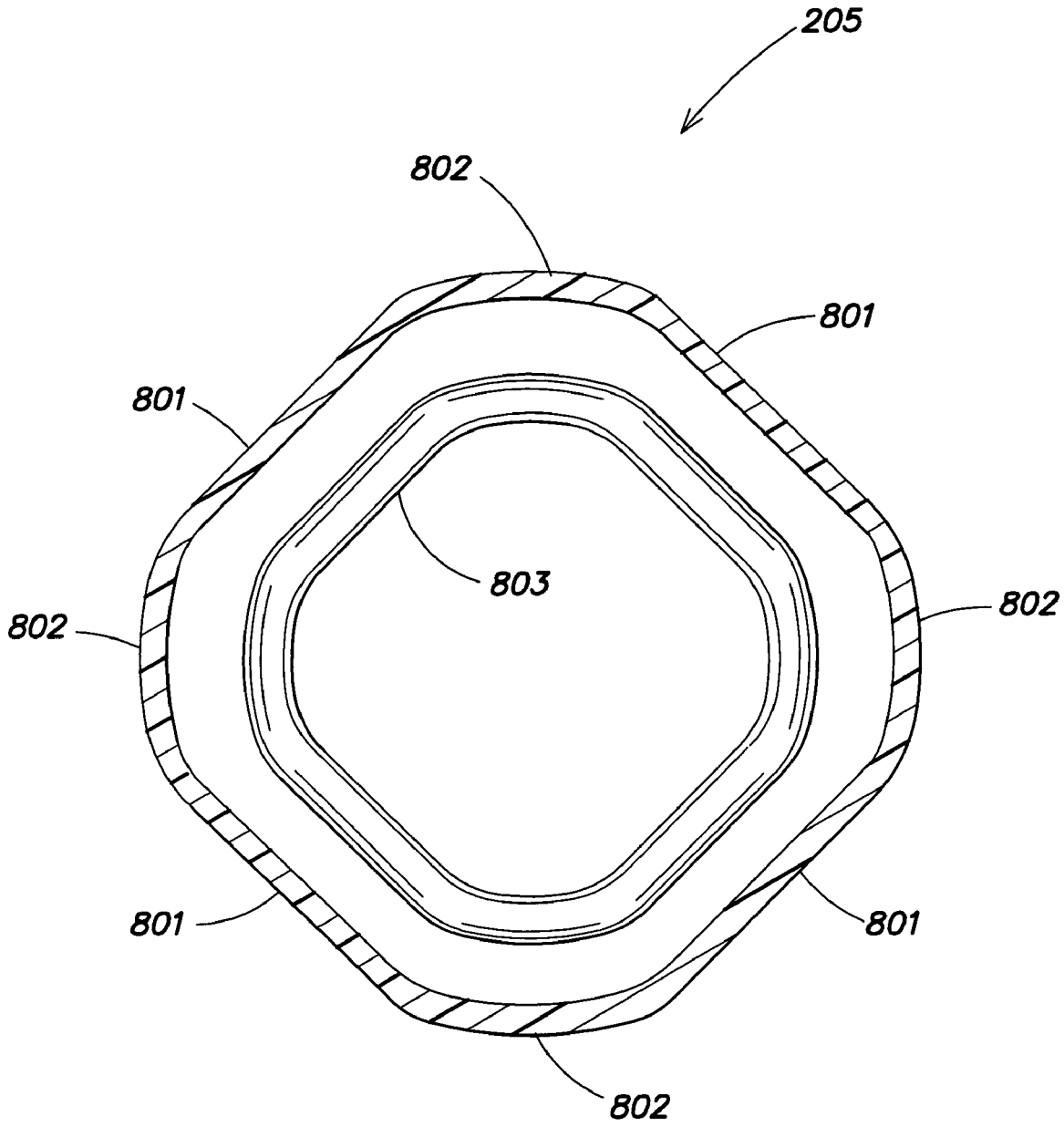
FIG. 8 is a cross-sectional view of a payout tube taken along lines 8—8 in FIG. 7 of the invention.

FIGS. 4–6 show a payout tube 205 situated in the end 402 of a box 400. FIG. 7 shows the same payout tube 205, separate from the box 400, and FIG. 8 shows a cross-section of the payout tube taken along line 8—8 of FIG. 7. The payout tube 205 extends from box wall 402, through the coil of cable 501 and to a position inside of the coil of cable 501 to allow cable 502 to unwind from a position internal to the coil of cable 501. To accomplish this effect, the payout tube 205 is placed through the opening 503 in the coil of cable 501 either while the cable 502 is being formed into a coil or after the coil of cable has been formed.

As shown in FIG. 7, the payout tube 205 has a tapered body 701 and a flange 702. The tapered body 701 of the payout tube 205 facilitates insertion of the payout tube 205 into the coil 501 and also serves to minimize the amount of divergence required between the loops of cable within the coil 501. Although the body 701 of the payout tube 205 is tapered as shown in FIGS. 4–8, the invention may also include payout tubes that are not tapered, as aspects of the invention are not limited in this respect. The flange 702 of the payout tube 205 is adapted to be disposed outside the end wall 402 of the box 400 when the box is assembled. The payout tube 205 shown in FIGS. 4–8 is made of a plastic material, although other suitable materials can be used, such as cardboards, papers, metals, and composites.

The payout tube 205 shown in FIGS. 4–8 has a body 701 of non-circular cross-section, and in particular, a tapered, cross-section with four substantially flat sides 801 and for arcuate sides 802. The inventor has found that some payout tubes with circular cross-sections can deform when they are placed through an opening 503 in a coil 501. The loops of coil forming the diverging planes can serve to apply compression forces against the body 701 of the payout tube 205. These compression forces can deform a payout tube 205 that is not designed appropriately. For instance, the payout tube having a body with a circular cross-section may deform under such compression forces whether the body is tapered or not. To address these issues, the payout tube of the present invention has been constructed and arranged in a non-circular cross-sectional shape that resists compression forces. The particular cross-section shown in FIG. 8 has four substantially flat sides 801 connected by arcuate side portions 802, although other cross-sections such as square, diamond-shaped, or any other suitable shapes, may be used as the invention is not limited in this respect. Another feature that helps resist the compression forces is the reinforced lip 803 at the end of the body 701 opposite the flange 702. The lip 803 shown in the figures comprises a reinforced section of plastic molded into the payout tube body. However, the lip may also comprise other materials such as wire, a separate piece of plastic, or a reinforced piece of cardboard as the invention is not limited in this respect. Both the non-circular shape and the lip may be used individually or in combination to resist compression forces that the payout tube 205 may be subjected to, particularly when placed into the opening of a coil.

Disposed on the body of the payout tube 205 and adjacent to the flange 702 are a plurality of recesses 206 that are adapted to receive protrusions (FIG. 6, 601) in a panel forming wall 402 of the box 400. The engagement between the recesses 206 and protrusions 601 retains the payout tube flange 702 against the panel forming wall 402 of the box 400. This configuration allows the payout tube 205 to be held, in the embodiments of FIGS. 4–6, by an end wall comprising only a single ply of cardboard. It also allows the payout tube 205 to be held without additional, reinforcing sheets of cardboard or similar materials. The flange 702 also helps prevent the payout tube 205 from being pressed further into the box 400. Collectively, the flange 702 and the interaction between the protrusions 601 and the recesses 206 retain the payout tube in its position. While the illustrated embodiment shows four recesses 206 and four protrusions 601, other embodiments of the invention may comprise a different number of protrusions and recesses.

Figure 9:
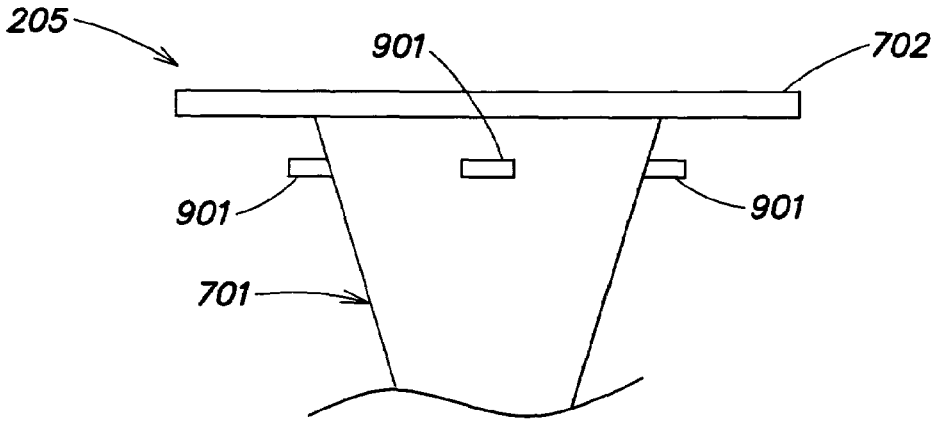
FIG. 9 is a side view of an alternate payout tube.
Figure 10:
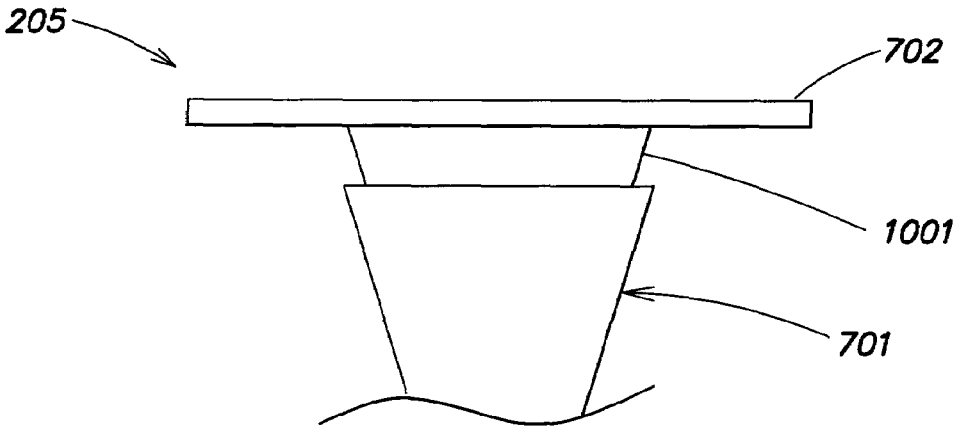
FIG. 10 is a side view of yet another alternate payout tube.
Figure 11:
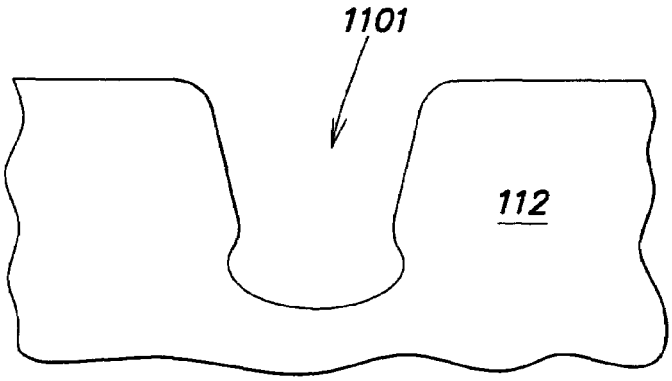
FIG. 11 is a plan view of a detail of an alternate embodiment of the aspect shown in FIG. 2.

As shown in FIG. 9, still other embodiments may have protrusions 901 on the body 701 of the payout tube 205 at a position inward from the flange 702. These protrusions 901 on the payout tube 205 may interact with recesses in the large opening or slot (FIG. 2, 201; or FIG. 11, 1101), or simply with the aperture itself. Still other embodiments may accomplish the same effect with a different form of protrusions. For instance, as shown in FIG. 10, the payout tube may be held in the large opening or slot (FIG. 2, 201; or FIG. 11, 1101) by the interference of a recessed groove 1001 on an outer surface of the payout tube 205 near the flange 702. Such a groove 1001 may accept the edges of the opening or slot and hold it rigidly in place. In this case, the large opening or slot 405 may have an end of a similar shape as the groove 1001 or may alternatively have a different shape such as a rectangular shape that will naturally have interference points with a circular groove. For example, as shown in FIG. 11, the slot 1101 may have a keyhole shape for retaining the payout tube 205.

An adhesive sheet 406, as shown in FIG. 4, may be applied to the end wall 402 of the box 400 over the surface surrounding the aperture 405 to further insure that the payout tube 205 is held in place, prevent foreign debris from entering the payout tube and/or, help retain an outer end (FIG. 5, 504) of the cable 502 inside of the box when it is not being dispensed. The adhesive sheet 406 shown in FIG. 4 is made of a clear plastic sheet, although other translucent or opaque sheets may be used. Such sheets may be made of any suitable material and may also be held to the box 400 by means other than adhesives, such as staples as the invention is not limited in this manner. Slits 407 may be placed in the adhesive sheet at a point over the aperture 405 in the end of the box as shown in the figures. Such slits allow a user to easily access inside the payout tube 205 when cable 502 is ready to be dispensed.

FIGS. 6 and 7 show among other things, a cable lock 602 disposed inside of the payout tube body 701. The cable lock 602 comprises a hole in the wall of the payout tube that is sized to hold the cable, wire, or other filamentary product. Adjacent to the hole are several slits 603 extending radially from the center of the hole. These slits 603 create compliant sections that serve to grasp a cable 502 that is larger in diameter than the hole itself. In addition to helping grasp the cable 502, the compliant sections allow a wider range of cable diameters to be held in a given size cable lock 602.

The following describe steps that may be taken to assemble the box and coil shown in FIG. 4. The box 400 can be formed from a sheet of cardboard or other suitable material by any suitable method, such as die cutting followed by folding by a progressive die folding machine, manually, or otherwise. An openable face 401 is either left in an open position or opened when the coil is ready to be inserted. The coil of cable 501 is wound on a cable winding machine in a figure-eight configuration. An opening 503 in a wide side 505 of the coil of cable is retained during the winding process by directing loops of cable in two diverging planes 408 and 409. The coil is then placed inside of the box 400 through the openable face 401. A payout tube 205 is inserted through the aperture 405 in the end 402 of the box 400 and then through the opening 503 in the coil. The protrusions 601 in the aperture are locked into the recesses 206 of the payout tube 205, thereby holding the payout tube in place. The outer end 504 of the cable is then placed through the payout tube 205 in a position that may be reached by the user, such a position may include the cable lock 602. The openable flaps 401 are then closed and locked into the closed position with locking tabs 403 or other suitable features. An adhesive sheet may be placed over the end 402 of the box. Slits may then be cut in the adhesive sheet at a point over the aperture, or alternatively such slits may be cut in the adhesive sheet 406 before it is applied to the box 400.

While the invention has been illustrated and explained by descriptions of specific embodiments and examples of aspects thereof, many alternatives, modifications and variations will now be apparent to those skilled in the art. Accordingly, embodiments of the invention as set forth herein are intended to be illustrative, not limiting.

What is claimed is:

1. A box for paying out filamentary material from a coil of filamentary material contained in the box, the box having a pair of opposite faces and a front face with an aperture formed in the front face, the aperture shaped and sized to permit payout of the filamentary material through the aperture, wherein the opposite faces are on divergent planes and the opposite faces each share an edge with the front face; and the box being loaded with the coil of filamentary material.

2. A box as set forth in claim 1, further comprising a second pair of opposite faces, wherein said second pair of opposite faces are trapezoid shapes.

3. A box as set forth in claim 2, further comprising a payout tube extending from the aperture and through an opening formed through an edge of the coil for permitting payout of filamentary material.

4. A box as set forth in claim 3, further comprising a filament lock defined in a wall of the payout tube for retaining an outer end of the filamentary material.

5. A box as set forth in claim 4, wherein the filament lock comprises an opening through the wall of the payout tube and retention fingers extending into the opening to hold the outer end of the cable.

6. A box as set forth in claim 3, wherein a flange extends outwardly from an outer end of the payout tube and is secured to the front face.

7. A box as set forth in claim 6, wherein the flange is secured to the outside of the box.

8. A box as set forth in claim 3, wherein the payout tube is tapered.

9. A box as set forth in claim 3, wherein the payout tube has a multifaceted wall of alternating flat and arcuate sections.

10. A box as set forth in claim 9 wherein the multifaceted wall having four flat sections and four arcuate sections.

11. A box as set forth in claim 3, having a recess defined in the payout tube to engage an edge of the aperture.

12. A box as set forth in claim 11, wherein the recess comprises a slot defined through a wall of the payout tube.

13. A box as set forth in claim 11, wherein the recess comprises a groove defined around the payout tube near an outer end.

14. A box as set forth in claim 2, wherein the box is defined by only one sheet of material.

15. A box as set forth in claim 1, wherein the front face is formed of two overlapped flaps, one of which has a slot defined therein for receiving the payout tube radially to a central axis of the payout tube.

16. A box as set forth in claim 15, wherein the slot has tabs defined thereabout for retaining the payout tube.

17. A box as set forth in claim 15, wherein the slot has a keyhole shape for retaining the payout tube.

18. A box as set forth in claim 15, wherein the box is defined by two sheets of material, the second sheet of material defining the one of the flaps having the slot.

19. A box as set forth in claim 15, wherein the box is defined by only one sheet of material.

20. A box as set forth in claim 1, wherein the opposite faces are inner faces, the box further comprising:

a pair of outer faces on parallel planes outside of the pair of opposite faces.

* * * * *